US007637304B2

(12) United States Patent
Beale et al.

(10) Patent No.: US 7,637,304 B2
(45) **Date of Patent: *Dec. 29, 2009**

(54) ALUMINUM INGOT CASTING MACHINE

(75) Inventors: David James Beale, Ontario (CA); Matthew James Astill Holmes, Ontario (CA)

(73) Assignee: Outotec Oyj, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/167,543

(22) Filed: Jul. 3, 2008

(65) Prior Publication Data

US 2008/0277091 A1 Nov. 13, 2008

Related U.S. Application Data

(63) Continuation of application No. 10/649,164, filed on Aug. 27, 2003, now Pat. No. 7,406,997.

(30) Foreign Application Priority Data

May 5, 2003 (CA) ..... 2427894

(51) Int. Cl.
*B22D 7/00* (2006.01)

(52) U.S. Cl. ..... 164/323; 164/326

(58) Field of Classification Search ..... 164/323, 164/326, 329

See application file for complete search history.

(56) References Cited

U.S. PATENT DOCUMENTS

| | | | | |
|---|---|---|---|---|
| 3,174,197 | A | 3/1965 | Stauffer | |
| 3,200,451 | A * | 8/1965 | Worswick | 164/156.1 |
| 3,862,839 | A | 1/1975 | Shimizu | |
| 3,910,620 | A | 10/1975 | Sperry | |
| 3,972,368 | A * | 8/1976 | Kikkawa et al. | 164/76.1 |
| 4,299,269 | A | 11/1981 | Friesen | |
| 4,589,467 | A * | 5/1986 | Hunter | 164/326 |
| 5,449,395 | A | 9/1995 | George | |
| 5,664,617 | A | 9/1997 | Patton et al. | |
| 7,308,929 | B2 | 12/2007 | Beale et al. | |
| 7,406,997 | B2 * | 8/2008 | Beale et al. | 164/323 |

FOREIGN PATENT DOCUMENTS

CA 2240332 A 12/1998

(Continued)

OTHER PUBLICATIONS

Biswas and Davenport, "Extractive Metallurgy of Copper", Pergamon, Oxford, 1994, pp. 312-315.

*Primary Examiner*—Kevin P Kerns
(74) *Attorney, Agent, or Firm*—The Webb Law Firm

(57) ABSTRACT

An aluminum ingot casting machine having a source of molten metal, a rotatable annular ring, carrying ingot casting moulds and a drive member for indexing the moulds. The machine includes a vacuum demoulder having a vacuum seal arrangement having a sealing element having a flexible core which can deform to form a vacuum seal against an ingot and a flexible abrasion resistant outer layer on the core, and retaining elements located on a lower face of the vacuum lifting head for releasably retaining the sealing element onto the lifting head. The vacuum seal has a flexible ring shaped body, being rounded in cross section, having a fibre cord core and an abrasion resistant flexible sheathing surrounding the core.

20 Claims, 8 Drawing Sheets

FOREIGN PATENT DOCUMENTS

| | | | |
|---|---|---|---|
| DE | 1774997 | B | 10/1973 |
| DE | 19623214 | A | 1/1997 |
| SU | 1071562 | A | 2/1984 |
| WO | 02/22292 | A | 3/2002 |
| WO | 02/26421 | A | 4/2002 |

* cited by examiner

ALUMINUM INGOT CASTING MACHINE

This application is a continuation of U.S. patent application Ser. No. 10/649,164 filed Aug. 27, 2003, which has issued as U.S. Pat. No. 7,406,997, on Aug. 5, 2008 and which is incorporated herein by reference in its entirety.

FIELD OF THE INVENTION

This relates generally to the field of molten metal processing, and more particularly to machines and methods for metal ingot casting.

BACKGROUND OF THE INVENTION

Metal is processed in a number of ways. For some metals the preferred form of production is in the form of ingots, which are then transported to metal working shops, for example rolling mills, for further processing and fabrication. Aluminum is one type of metal which is typically cast into ingots. Ingots may be made in various sizes, depending upon the size of the smelter and other factors. One common size for ingots is a large size which is commonly referred to as "sow".

Casting aluminum ingots has certain requirements. For example, it is preferred if the casting can continue without stopping. This avoids having molten metal solidify where it is not desired, such as in a furnace or in a delivery launder or the like. However, continuous production requires continuous removal of molten metal, which in turn requires continuous casting. Continuous casting machines typically take the form of a circle, to permit continuous filling, removal and refilling of ingot forming moulds. In one common type of casting machine, a plurality of moulds are supporting in a casting ring, which in turn is supported from a central axle having radial arms supporting the casting ring.

As the ring indexes forward the moulds are poured to form ingots and then the ingots are slowly cooled. After cooling, the ingots are removed from the moulds and then the moulds are presented for refilling. Commonly, the carousel ring is driven from its center axle.

More recently, the ingots have been removed from the moulds by means of a vacuum system or apparatus. The apparatus typically includes a vacuum source, and an overhead vertically translatable vacuum head having a vacuum seal for engaging the ingots. To remove the ingots from the moulds, the vacuum seal is placed on the ingot, and the vacuum is initiated. The vacuum causes the vacuum seal to compress against the surface of the ingot. The ingot is then lifted out of the mould by the vertically translatable vacuum head.

There are a number of problems with the prior art systems as described above. First, the use of a central axle with arms supporting the ring requires very strong arms to support the cantilevered load of filled moulds. This requires a significant amount of structural support, which also adds to the overall weight of the carousel. The heavier the carousel is, the harder it is to make it rotate smoothly and the more powerful a drive is required. Stopping and starting the ring as each mould is indexed to the next station becomes more difficult the larger the ring is.

Further, having ring supporting arms that extend like spokes through and rotate through the inside of the ring renders the space inside the ring largely unusable. This in turn has a number of drawbacks. For example, the ring cannot be placed in a location where building columns would be positioned inside the ring, because such columns would interfere with the rotation of the arms. Also, the components of the ring are not accessible from inside the ring for maintenance and operational purposes, which reduces the flexibility of the machine. Furthermore, it is often useful to be able to position some system components, such as water piping for the ingot cooling means, inside the ring. However, the positioning of components inside the ring is made awkward and impractical by reason of the movement of the arms.

As well, even a very carefully moulded ingot has small sharp surface features which are an inevitable part of the moulding process. When the vacuum seal contacts the surface of the ingot, and the vacuum is engaged, the seal is sucked inward slightly, thus rubbing against the ingot surface, including the sharp surface features. To form the seal requires a flexible, rubber-like material. Even the best materials tend to get softer at higher temperatures, such as those associated with the recently poured ingots. It has been found that this combination of heat and abrasion quickly causes a loss of integrity of the seal leading to a failure of the lifting system. The system further requires a shutdown to permit the seal to be unfastened and replaced. This is typically made difficult, because in an effort to reduce wear on the seal, the seal is held in place by multiple fasteners which are difficult to remove, thus increasing down time and costs.

Therefore, what is desired is a metal ingot casting machine which overcomes the foregoing disadvantages. More specifically, it is highly desirable to be able to position the casting ring at any convenient location, without requiring the fully clear circular footprint of the prior art machines. As well, it would be preferred if the casting system could be provided with a ring which was lightweight and thus easy to motivate even when filled with metal ingots.

SUMMARY OF THE INVENTION

Therefore according to the present invention there is provided a casting ring which is fully supported from below, and in which the space inside the ring is clear so that it is available for use for purposes other than simply supporting the casting ring. Preferably a sturdy, but relatively lightweight and thus nimble casting ring can be formed by supporting the ring on rails, which in turn are supported on rollers, which are either floor mounted or mounted to the underside of the ring. Rails are preferred to support the ring on the rollers.

In another aspect of the invention, a vacuum seal arrangement is employed in which abrasion and erosion of the vacuum seal is reduced and which permits the easy, quick and effective replacement of the seal in the event it is required. Elements, such as limit stops and seal shields are used to specifically reduce abrasion wear on the seal.

Thus, according to the present invention there is provided an aluminum ingot casting machine comprising:

- a source of molten metal;
- a rotatable annular ring, said annular ring having a generally vertical axis of rotation and being sized and shaped to carry a plurality of ingot casting moulds; and
- a drive means for indexing said moulds to said source of molten metal by rotating said annular ring.

In another aspect of the invention, there is provided a vacuum seal arrangement for use on a vacuum lifting head for lifting metal ingots, said vacuum lifting head having a source of vacuum, said vacuum seal arrangement comprising:

- a sealing element having a flexible core which can deform to form a vacuum seal against an ingot and a flexible abrasion resistant outer layer on said core, and
- one or more retaining elements located on a lower face of said lifting head for releasably retaining said sealing element onto the lifting head.

In another aspect of the invention, there is provided a vacuum seal for use in a lifting head having a source of vacuum sufficient to lift ingots from moulds, said vacuum seal comprising a flexible ring shaped body, being rounded in cross section, having a fibre cord core and an abrasion resistant flexible sheathing surrounding the core.

BRIEF DESCRIPTION OF THE DRAWINGS

Reference will now be made to drawings which depict, by way of example only, preferred embodiments of the invention, and in which.

DETAILED DESCRIPTION OF THE PREFERRED EMBODIMENTS

Figure 1:
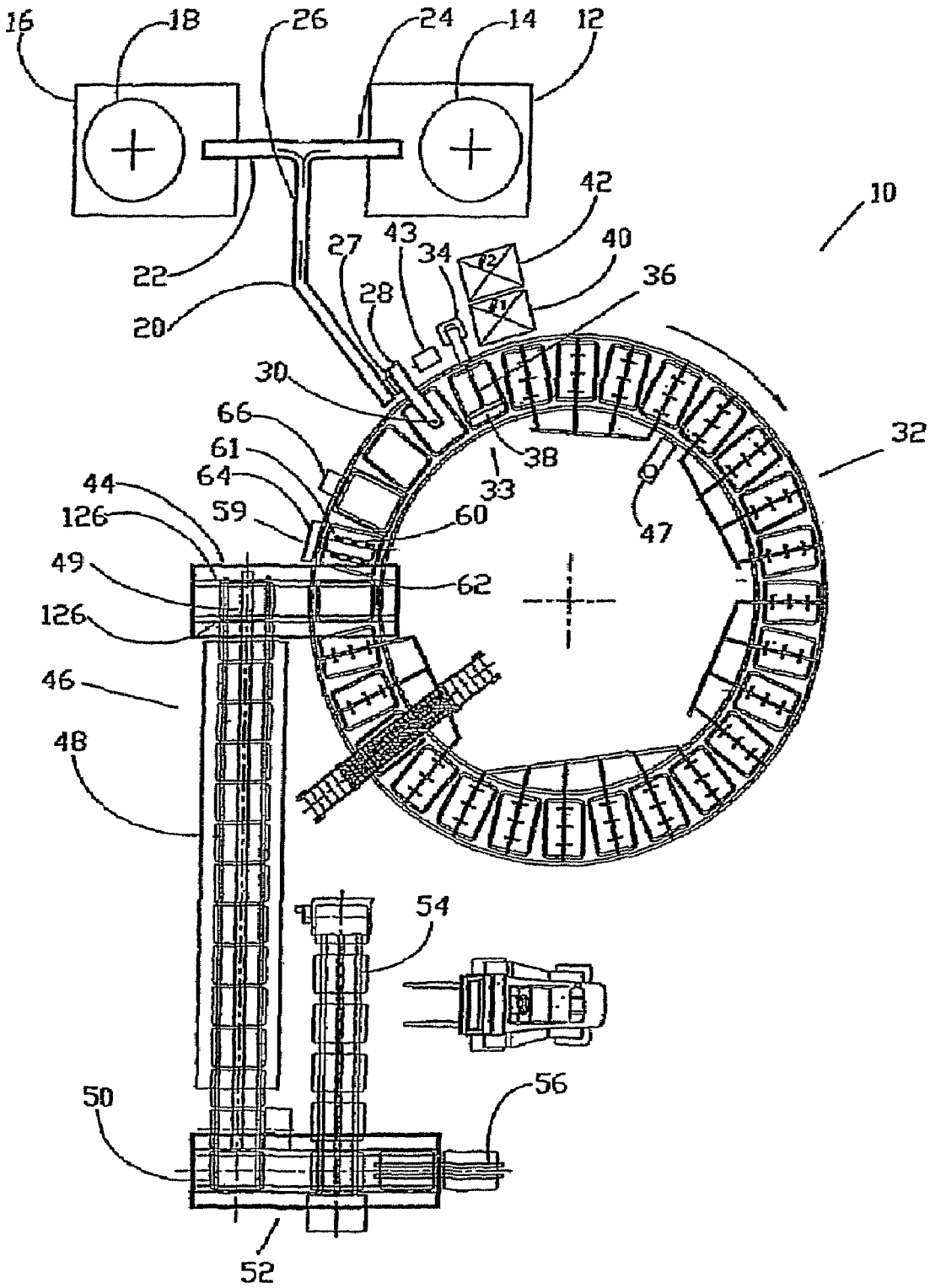
FIG. 1 is a plan view of the preferred embodiment of the aluminum ingot casting machine of the present invention.

Referring now to FIG. 1, the aluminium ingot casting machine, according to the present invention and generally designated by reference numeral 10, comprises a first crucible tilter or frame 12 having a first crucible 14 removably placed therein and a second crucible tilter or frame 16 having a second crucible 18 removably placed therein. The machine further includes a launder system 20 (preferably Y-shaped), comprising a first lateral portion 24 positioned to receive molten metal from the first crucible 14, and a second lateral portion 22 positioned to receive molten metal from the second crucible 18. The launder system 20 further includes a central portion 26 connected to the lateral portions 22,24 and is connected via a rotary joint 27 to a tundish 28. The tundish 28 includes a downspout most preferably in the form of a ceramic nozzle 30.

The aluminium ingot casting machine 10 further includes a rotatable annular ring having a generally vertical axis of rotation, preferably in the form of an ingot casting carousel wheel 32 (and associated support structure described below). The preferred form of the carousel wheel 32 is approximately 16 metres in diameter, and supports twenty-eight cast steel moulds in individual pockets located at twenty-eight mould positions (M1-M28). During the casting process, the pockets are indexed forward, from one position to the next, each indexing taking place at a predetermined time after the previous indexing. Thus, each mould gets indexed, position by position, to M1 and then through the intermediate mould positions to M28. The cycle continually repeats while the machine 10 operates.

The function of each of the twenty-eight mould positions on the carousel wheel 32 will be described in greater detail below. However, it will be appreciated that the annular ring in the form of the carousel wheel 32 need not necessarily include twenty-eight mould positions. Other numbers of mould positions are possible. What is important is that the carousel wheel 32 be sized and shaped to carry a plurality of ingot casting moulds.

Thus, as the aluminum ingot casting process begins, molten metal is poured into the launder 20 from one of the pivoting crucibles 14, 18. The molten metal flows along the launder 20, to the pivoting tundish 28. The tundish 28 preferably underpours (through the ceramic nozzle 30) molten metal into the mould at the first mould position M1 of the carousel wheel 32.

It will be appreciated that underpouring of the molten metal is preferred because it reduces the amount of dross formed during the pouring process. Specifically, dross forms on the surface of molten metals, such as aluminum, when the layer of metal that is in contact with the air oxidizes. Thus, when the metal pouring begins, a surface layer of dross forms. As the underpouring continues, the molten metal enters the mould from under the layer of dross. The layer of dross acts as a shield that keeps air from contacting the underpoured metal under the layer of dross, thus preventing the oxidation of that metal and the formation of more dross. The surface layer of dross is then skimmed off, as will be described in more detail below.

Preferably, during indexing of the carousel wheel 32, the tundish 28, by means of the joint 27, pivots upward out of the mould to a raised, non-pouring position. This allows the wheel 32 to index without interference by the tundish 28. Once the index is completed and an empty mould is available for pouring, the tundish 28 pivots to a lower, pouring position, with the nozzle 30 in the mould, and begins underpouring molten metal into the mould.

Thus, in the preferred embodiment, the crucibles 14, 18, the launder 20 and the tundish 28 act as a source of molten aluminum or other metal. It will be appreciated that the source of molten metal need not take the preferred form described above; the invention comprehends other sources of molten metal. For example, the source of the molten metal may include a melting furnace or a holding furnace. What is important is that a source of molten metal be provided to supply material for the casting of ingots.

The preferred machine 10 further includes a skimming station 33, which includes an automatic skimming apparatus sized and shaped to remove dross from the surface of each poured ingot immediately after it is poured. Preferably, the skimming apparatus takes the form of a robotic skimmer 34, positioned at the skimming station 33 at position M2 of the carousel wheel 32. Thus, the skimmer 34 is positioned at the station 33 adjacent to where the molten metal is poured into the moulds (M1), in the direction of rotation of the wheel 32. The robotic skimmer 34 includes a robotic arm 36 carrying a replaceable spatula 38 for skimming dross.

In operation, the spatula 38 skims over the surface of the molten metal in the mould from the furthest position from the robotic skimmer 34 to the nearest position. The spatula 38 skims dross from the surface of the metal. The arm 36 then swings around and deposits the collected dross into a first skim pot 40 or a second skim pot 42 of the skimming station 33.

A proximity switch is associated with the skimmer 34, for detecting the presence of a mould requiring skimming in the skimming position M2, and for triggering the operation of the skimmer 34. The skimmer 34 will not operate if no mould is present at the skimming station 33. Once the dross has been skimmed off, the spatula 38 is shaken over one of the two skim pots 40, 42 to deposit the dross therein.

When the first skim pot 40 is full, the skimmer 34 is switched to make use of the second skim pot 42. When the second skim pot 42 is full, the skimming apparatus 34 is switched to make use of the first skim pot 40. Each of the skim pots 40, 42 has a level sensor associated therewith to indicate whether the skim pot is full and if so, to communicate that information to the skimmer 34. Each time a skim pot becomes full, it is removed by forklift and replaced with an empty skim pot while the skimmer 34 disposes of collected dross in the other skim pot. A proximity switch is associated with the positions of each of the first and second skim pot 40, 42, in order to detect whether each of the skim pots is in place. The proximity switches are also connected to the skimmer 34, so that, if a particular skim pot is not in place, then the skimmer 34 will not attempt to deposit dross into the absent skim pot.

It will be appreciated that the invention also comprehends a number of skim pots that is more or less than two. However, there will preferably be at least two skim pots so that the skimming can continue while one skim pot is being emptied.

Preferably, the machine 10 further includes a natural gas fired preheater 43 mounted within reach of the arm 36, for heating the spatula 38 prior to skimming. Most preferably, the robotic skimmer 34 is programmed to keep the spatula 38 in the burner flame of the preheater 43 for a prescribed time in order to achieve a desired, predetermined temperature for the spatula 38.

The machine 10 further includes a drive means 47, associated with the carousel wheel 32, for indexing moulds from one position to the next around the carousel wheel 32. The drive means 47 will be more particularly described below.

In the preferred embodiment of the machine 10, mould positions M3-M24 are used for progressive water spray cooling of the mould in the carousel wheel 32. The machine 10 thus includes a water sprayer cooling system 45, located below the carousel wheel 32, which will be more particularly described below.

The machine 10 further preferably includes a demoulder means in the form of a vacuum demoulding station 44, which removes ingots from the moulds at position M25 of the carousel wheel 32. At the demoulding station 44, the ingots are transferred from the carousel wheel 32 to a secondary cooling line 46, positioned to receive the ingots, having at its first position a first weighing station 49. The ingots are indexed by a conveyor (described in more detail below) along the secondary cooling line 46. On the secondary cooling line 46, additional cooling water from a water source is sprayed on the ingots at each position of the line 46. In addition, a counter-current air flow is provided within the cooling tunnel 48 to provide additional heat exchange with the ingots that are being cooled.

Once the ingots have indexed through the secondary cooling line 46, they reach a second weighing station 50 located at the last position of the line 46. The weigh scales at the weighing stations 49,50 are certified (legal for trade) scales. The weight of each ingot is recorded at both locations for comparison purposes, and for continuous backup so that if one scale fails, the other can still be used.

After the ingots are weighed at the second weighing station 50, they are removed by a lifting and translating machine 52. The lifting and translating machine 52 stacks ingots either on the exit conveyor 54, or the reject conveyor 56.

The lifting and translating machine 52 includes a grab head carrying four grabs that are actuated under the ingots. The head then lifts the ingots and travels to the stacking position on either the exit conveyor 54 or the reject conveyor 56, depending on whether the ingot being moved is to be accepted or rejected. The ingot is lowered onto an existing partial stack if one is present. When the grabs are no longer bearing a load, they are retracted. The grab head then returns to the pickup position for the next ingot.

In the preferred embodiment, once a stack of five ingots is formed, the exit conveyor 54 indexes the stack away from the stacking position, thus clearing the way for the next ingot and the next stack. The same procedure is followed on the reject conveyor 56.

The exit conveyor 54 preferably has five positions. The first is the stack formation position. Once the stacks are formed, they are indexed to the other four positions, which are accessible to a forklift truck. Thus, while stacks are being formed in the first position, a forklift truck removes stacks of ingots from positions 2-5 of the exit conveyor 54. In the preferred embodiment, the reject conveyor 56 has two positions, the first being a stack formation position and second being a storage position that is accessible to a forklift truck.

Returning now to the carousel wheel 32, the carousel wheel 32 is indexed forward after each ingot is removed from the mould at position M25, leaving the mould empty. Position M26 preferably has associated therewith a mould wash station 59 (i.e. a release agent coating station). A release agent is a chemical composition that facilitates separation of the ingots from the moulds, by making the surface of the moulds less sticky. To apply release agent to the mould, a spraying system 61 is associated with position M26 of the carousel wheel 32, and positioned so as to permit a pneumatic sprayer to spray release agent onto the moulds that are indexed into position M26. The pneumatic sprayer has two fixed pipelines 60,62, each pipeline 60,62 having three nozzles extending over the inside of the mould to provide six sources simultaneously spraying a release agent evenly onto the mould as it sits under the nozzles. Preferably, the release agent will be a graphite-based release agent.

The spraying system is connected to a reservoir 64 which contains the release agent to be sprayed onto the moulds. Preferably, the reservoir 64 contains a sight level gauge and a level switch for low level indication. Preferably, the reservoir 64 will also include air-based agitators that keep the release agent solids in suspension while the spraying system is not in use.

Preferably, the mould wash station 59 can be actuated by an operator at his discretion, based on his visual inspection of the moulds, and/or his determination that the moulds are becoming "sticky", making demoulding more difficult. Alternatively, rather than having a system actuated at the discretion of an operator, an automatic spraying system can be used. In such a case, a proximity switch is included in the spraying system which detects the presence of a mould. When the mould is detected at position M26, the release agent is sprayed evenly onto the mould for a predetermined period of time (usually 3-4 seconds).

It will be appreciated by those skilled in the art that it is advantageous to remove moisture from the moulds prior to pouring. This is because the moisture, when contacted by liquid aluminum, may cause small explosions within the aluminium. Therefore preferably, the machine 10 includes a mould preheating station associated with position M27 on the carousel wheel 32. The mould preheating station includes a heater 66 which heats the moulds in the carousel wheel 32 as they are indexed into position M27.

In the preferred embodiment, position M28 of the carousel wheel 32 is a spare position which can be used to perform functions that are specific to the needs of the user.

After having been indexed to position M28, the mould is then indexed to position M1, where molten metal is deposited once again into the moulds, repeating the ingot casting process described above.

It will be appreciated that while the structure of the machine 10 described above is preferred, the invention comprehends other machines having different, non-preferred, structures. What is important is that the machine includes a source of molten metal (preferably continuous), a rotatable annular ring that is sized and shaped to carry a plurality of ingot casting moulds, and a drive means for indexing the moulds to the source of molten metal by rotating the annular ring.

Figure 2:
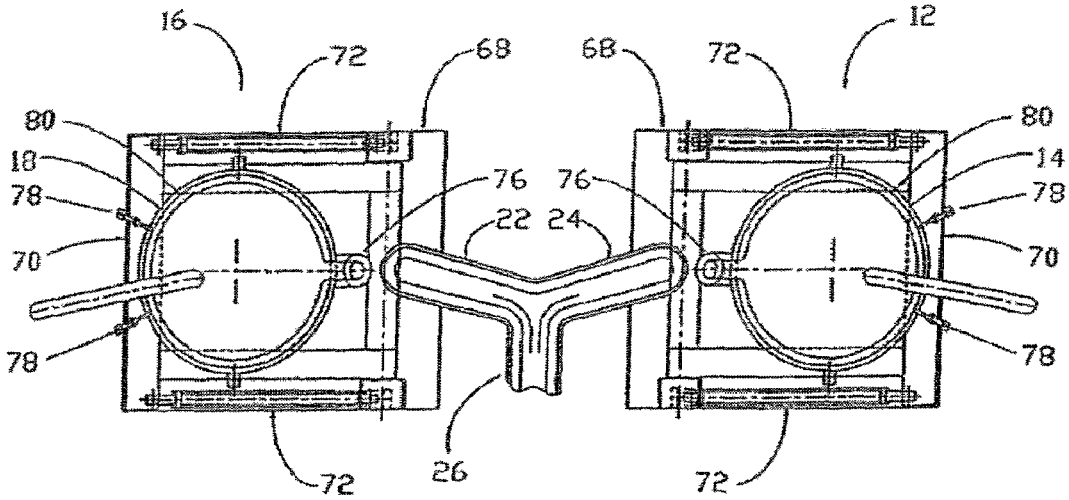
FIG. 2 is a plan view of two crucible tilters according to the present invention.
Figure 3:
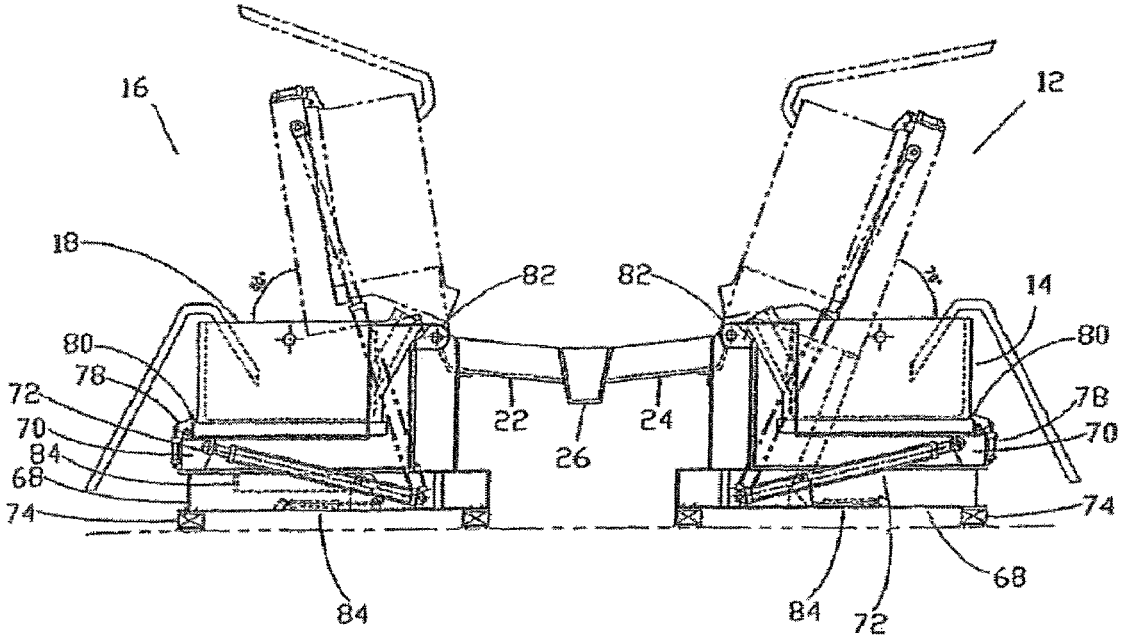
FIG. 3 is an elevation view of the two crucible tilters.

Referring now to FIGS. 2 and 3, the pivoting crucibles 14,18 removably carried in the tilters 12,16 are shown in greater detail. In FIG. 3, the crucibles 14,18 and tilters 12,16 are shown in solid outline in their untilted position, and in dotted outline in their fully tilted position.

Each of the two crucible tilters 12,16 is preferably a free standing unit comprising a rigid fixed base frame 68 on which an L-shaped frame 70 pivots. The frames 70 are preferably each actuated by two actuators in the form of electronic proportionally-controlled hydraulic cylinders 72. It will be appreciated, however, that a different number of actuators may be used. What is important is that each tilter frame have at least one actuator to tilt a crucible to pour molten metal into the launder 20.

Each base frame 68 preferably sits on four heavy duty load cells 74. Each tilter 12,16 further comprises a digital indicator arrangement associated with the load cells 74. Together, the indicator arrangement and the load cells 74 comprise an automatic weigh system for each tilter 12,16, permitting weighing of the molten metal in the crucibles 14,18.

Each tilting frame 70 is sized and shaped to receive and carry one of the crucibles 14,18. Each crucible 14,18 has a spout 76 which is positioned directly over the lateral portion 24 of the launder 20 in the case of the first crucible 14, and the lateral portion 22 of the launder 20 in the case of the second crucible 18. Thus, when tilted, each crucible pours molten metal from its spout 76 into the launder 20.

Preferably, the tilters 12,16, and in particular the tilting frames 70, will be sized and shaped to permit the use of different-sized crucibles. Most preferably, at least two different sizes of crucible can be accommodated in the tilters 12,16, including, for example, 20,000 pound crucibles and 12,000 pound crucibles. Thus, in use, the first tilter 12 may carry a larger crucible (say 20,000 pounds), while the second tilter 16 will carry a smaller crucible (12,000 pounds).

To accommodate different sizes of crucible, spacers 80, clipped into the frames 70, are provided for use with the smaller crucible (say 12,000 pounds). The smaller crucibles rest on the spacers 80. The spacer 80 is sized and shaped so as to position the spout 76 of the smaller crucible the same distance from the frame 70 as the spout 76 of the larger crucible. Thus, by virtue of the use of spacers 80 with smaller crucibles, the spout 76 is in the same position regardless of whether a small or large crucible is in use. This in turn allows crucible sizes to be changed without requiring the repositioning of the launder 20, or the tilters 12,16, for accurate pouring.

Preferably, each tilter 12,16 includes two latches 78 for securing the crucibles 14,18 to the frames 70 and for keeping the crucibles 14,18 in place during pouring. Each crucible 14,18 has platework on its rear side, which is used by the latches 78 to grip the crucibles. Most preferably, on each tilter 12,16, one latch 78 is provided for use with the larger (say 20,000 lb) crucible, and the other latch 78 is provided for use with the smaller (say, 12,000 lb) crucible. In the case where the smaller, 12,000 pound, crucible is used, one latch 78 is attached to the spacer 80 to retain the spacer 80 in place. The other latch 78 is attached to platework located at the rear of the smaller crucible, thus retaining it to the tilter frame 70 when in use.

It will be appreciated that the invention comprehends different numbers of latches and different latch configurations. What is important is that each tilter 12,16 preferably include at least one latch 78 for retaining the crucible to the tilter.

Figure 12:
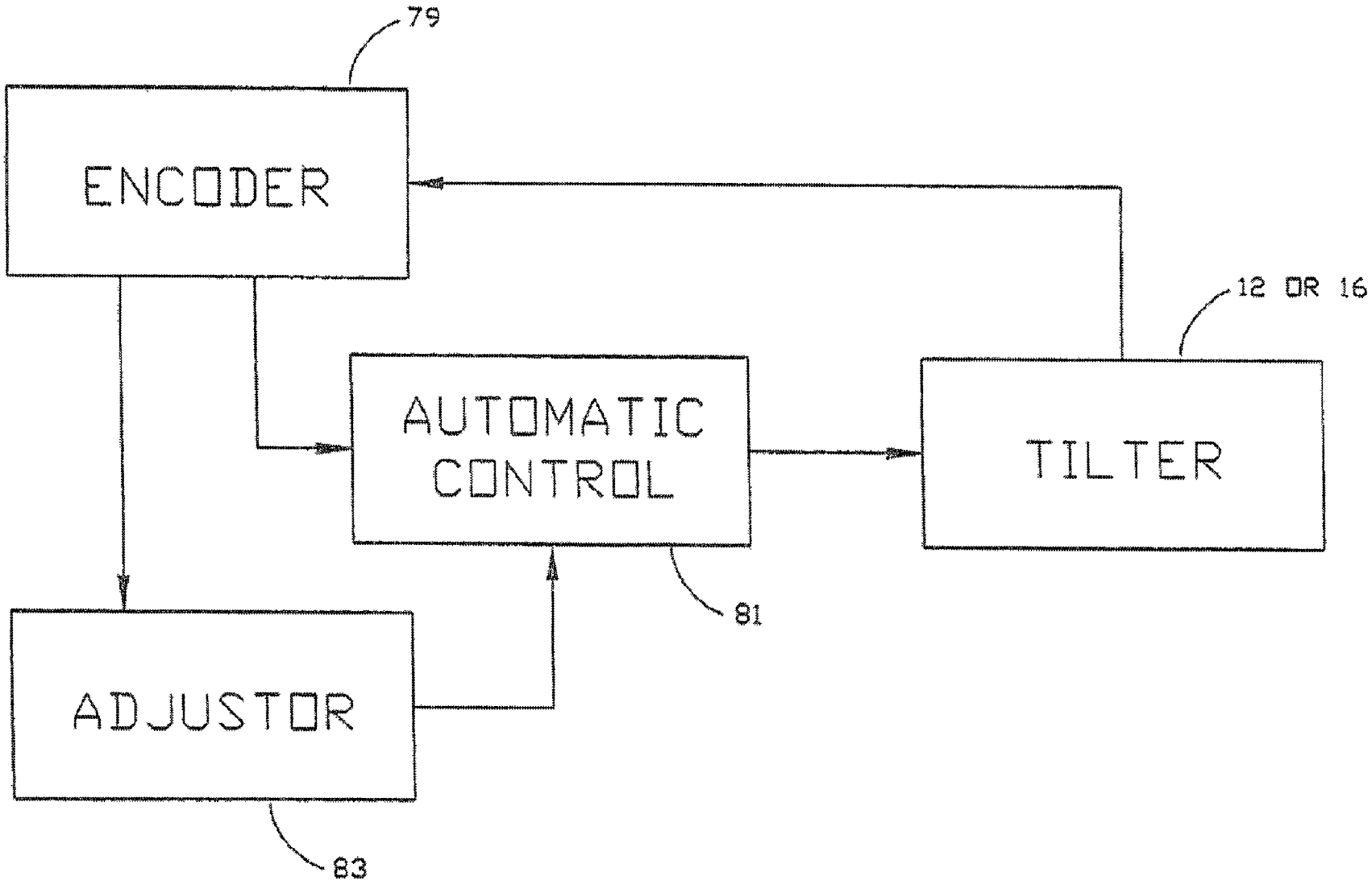
FIG. 12 is a schematic diagram of the crucible tilter control arrangement according to the present invention.

As shown in FIG. 12, the machine 10 preferably further includes a rotary encoder 79 operatively connected to each tilter 12,16, preferably by being fixed to the pivot axis 82 of the tilting frame 70. The encoder 79 is configured so as to measure the tilt position of the tilting frame 70 at all times. The machine 10 preferably further includes an automatic control 81 associated with the titters 12,16 and in particular, the frames 70. The automatic control 81 is connected to the encoder 79 and receives tilt position information therefrom. The automatic control 81 is configured to tilt the crucibles 14,18 in a controlled manner for pouring, based on the position information from the encoder 79. It will be appreciated that the automatic control 81 can take any form, including, for example, a PLC. What is important is that the control 81 be capable of automatically controlling pouring without manual control by an operator.

It will be appreciated that, as the tilt angle of the crucible 14,18, changes, the speed of tilting needs to change to maintain an even pouring rate while accounting for the changing volume of molten metal within the crucible. Thus, preferably, the automatic control 81 is associated with an adjustor 83 for each tilter 12,16 to vary the tilting speed to ensure an even rate of pour of molten metal out of the crucibles 14,18, and thus into the launder 20, the tundish 28, and the moulds. The adjustor 83 is connected to the encoder 79 to receive tilt position information to permit adjustment of tilting speed. It will be appreciated that the adjustor 83 can, inter alia, take the form of hardware, software, or a combination thereof. What is important is that the tilting speed be adjustable to maintain even pouring.

Manual controls are also preferably provided for the tilting frames 70. The controls provided include an emergency stop ("E-stop"), and, for each tilting frame, one joystick selector switch for automatic control, a selector switch for a 20,000 pound or 12,000 pound crucible, latch open/close controls and safety support leg controls.

In operation, when one of the crucibles 14,18 is placed on the corresponding tilter (12 or 16), the latches 78 are manually initiated. As a safety precaution, the tilting frames 70 are configured so that they will not move unless the latches have been actuated. Most preferably, the latches 78 include a safety switch to prevent the automatic controller from moving the frame 70 if the latches 78 are not secured.

Using the manual controls, the operator manually tilts the crucible to the pouring point, i.e. the point at which the metal is just at the lip of the spout 76. The operator then sets the frame 70 to automatic control via the selector switch, and the automatic control 81 controls the pouring of molten metal into the launder 20.

The automatic control 81 is configured to cause the tilters 12,16 to automatically back tilt to their untilted positions at the activation of any system E-stop, or loss of electrical power. Additionally, the manual controls associated with the tilting frame 70 are configured to allow an operator to back-tilt the crucibles 14,18 in the event of an emergency or power failure.

Preferably, the tilting frame 70 will have a proximity switch associated therewith which detects when the frame 70 has reached its full down position. Also, preferably, the cylinders 72 are configured and positioned so as to tilt to the frame 70 to a maximum angle of 80° C. from the horizontal.

When one of the crucibles has been emptied of molten metal, the automatic control 81 causes the second crucible to begin tilting and pouring to ensure a substantially continuous flow of molten metal into the launder 20. By means of the automatic control 81, the tilting frame 70 carrying the empty crucible will automatically back tilt to its full down position so that the crucible can be removed and replaced by a full crucible. When a full crucible is placed on the frame 70, the operator uses the manual control to tilt the crucible until the molten metal has reached a position just short of the edge of the spout, so that, if the crucible is tilted further, pouring will begin. The automatic control 81 then takes over the pouring process as described above.

A safety support leg 84 for the tilting frame 70 is also provided. The purpose of the support leg 84 is to provide a support for the tilter frame 70 for maintenance purposes. Thus, when maintenance is to be performed on the tilters 12,16, the tilter frame 70 is raised, and the support leg 84 is raised to a support position. The tilter frame 70 is then lowered onto a locating pin on the support leg 84. The hydraulics associated with the tilters 12,16 are then locked out. The tilter frame 70 is positioned at an angle of about 70 degrees from the horizontal for a safe maintenance environment.

Figure 4:
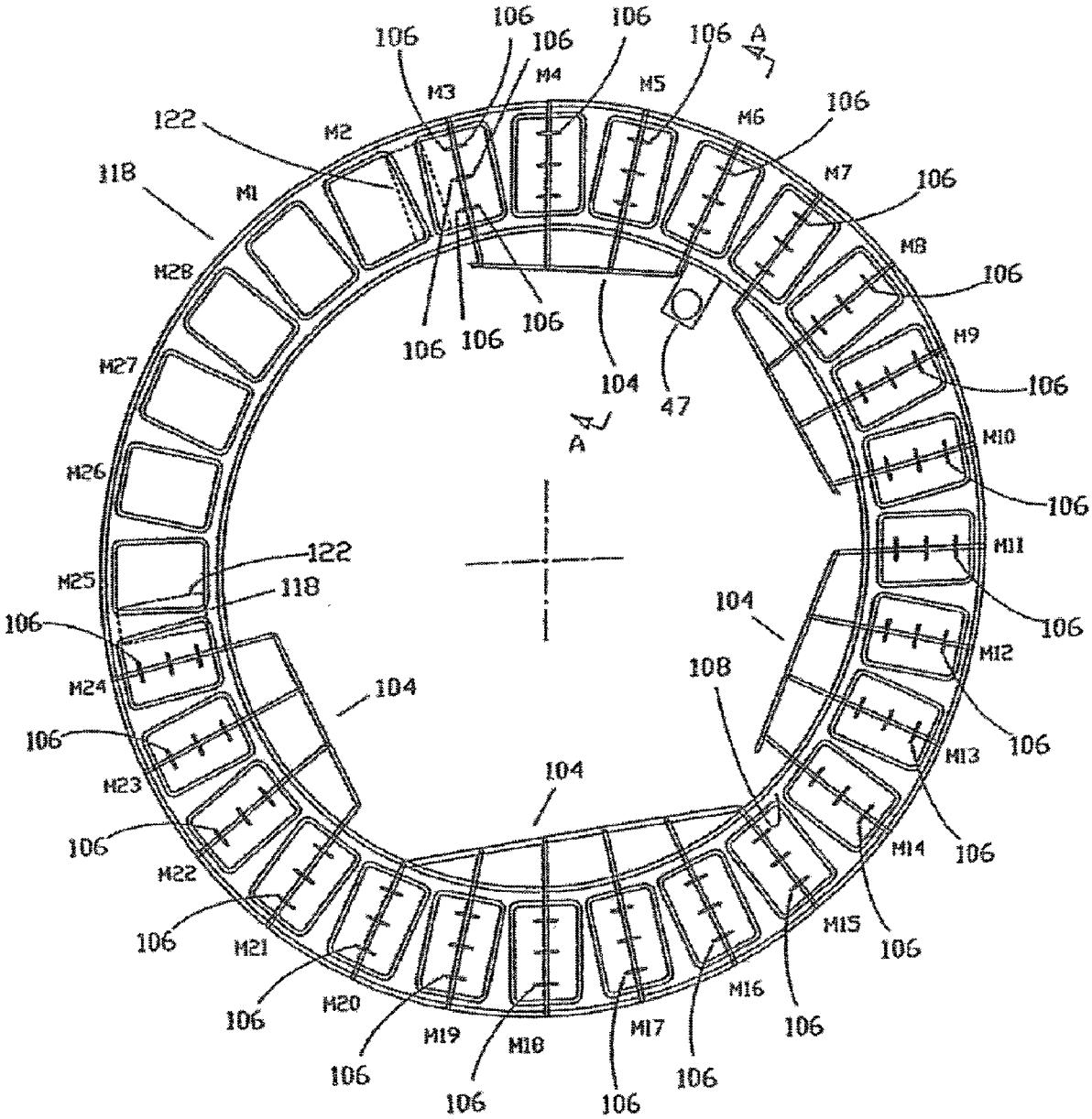
FIG. 4 is a plan view of a mould carousel according to the present invention.
Figure 5:
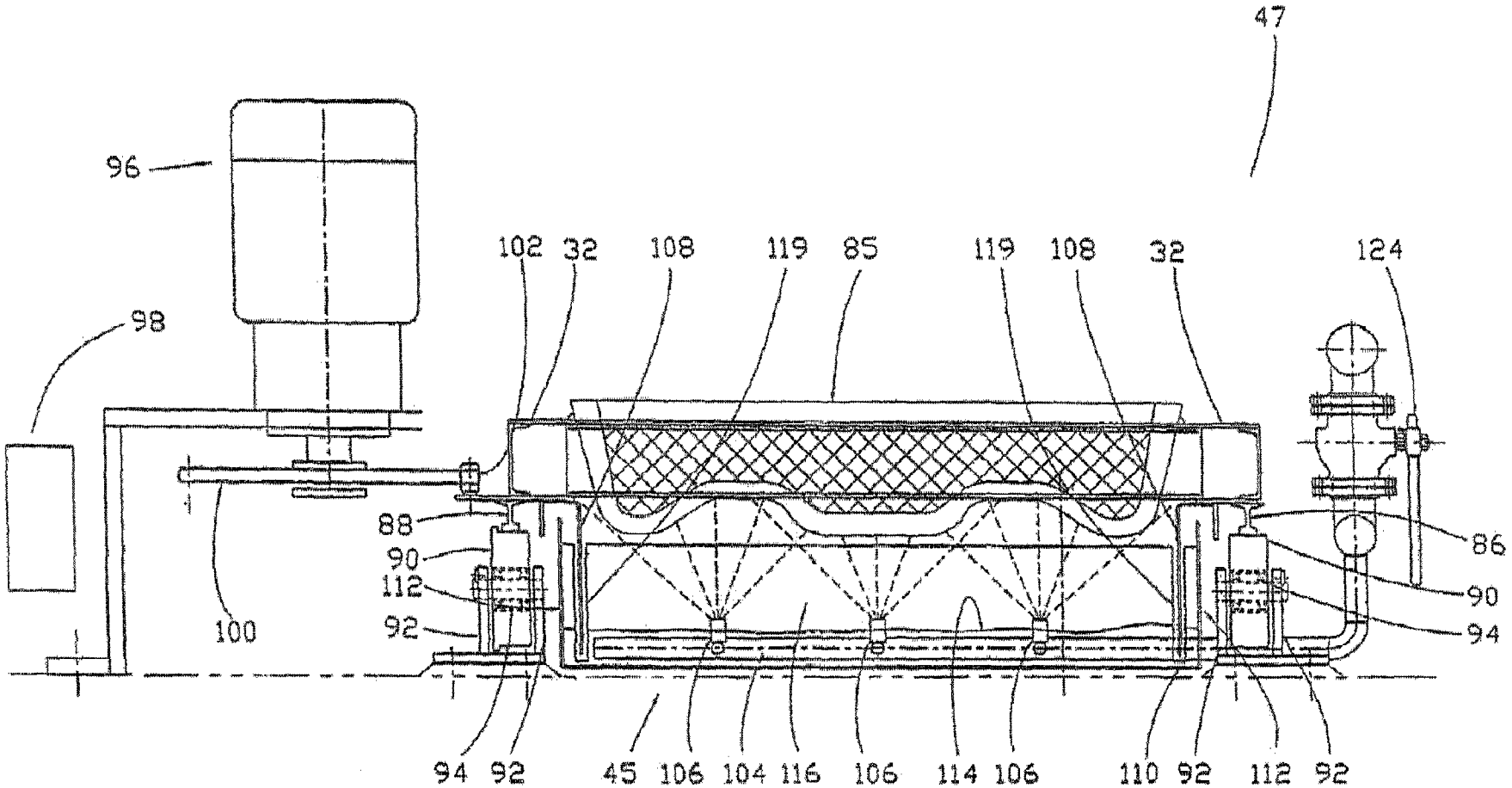
FIG. 5 is a cross-sectional view of the mould carousel, taken along line A-A of FIG. 4.

Referring now to FIGS. 4 and 5, the carousel wheel 32 is shown carrying moulds 85. The wheel 32 is supported by a support structure including an inner circular rail 88 and an outer circular rail 86. The inner circular rail 88 is concentric with the outer circular rail 86, and has a smaller radius than the outer circular rail 86. Each of the circular rails 86,88 is supported by a plurality of floor mounted support rollers 90 distributed about the circumference of each of the circular rails 86,88.

The support rollers 90 are supported by roller supports 92, to which the axle 94 of each support roller is mounted. The roller supports 92 are mounted on the floor.

The drive means 47 preferably is fixed to the floor adjacent to the wheel 32 and comprises an AC electric motor and gear box combination 96, powered by a variable frequency controller 98 for providing smooth and repeatable indexing of the wheel 32. The motor, gear box and controller drive a drive sprocket 100, which drives the wheel 32 by engaging drive gear means, preferably in the form of a series of cam followers 102 fixed to and distributed around the wheel 32. Thus, in the preferred embodiment, the drive means 47 acts between the floor and the wheel 32.

It will be appreciated that the invention comprehends other types of drive means 47 than the preferred form described above. For example, the cam followers 102 could be fixed to the inner circular wheel 88 or the outer circular wheel 86, with the drive sprocket engaging the cam followers 102. As the rails 86,88 are fixed to the wheel 32, driving the rails 86,88 would drive the wheel 32. As another example, the drive means 47 may be powered by other devices, such as a hydraulic motor, hydraulic cylinder, pneumatic motor or pneumatic cylinder. Alternatively, the rails 86,88 can be mounted on the floor, with the support rollers 90 being mounted on the rails 86,88, and the wheel 32 supported directly by the support rollers 90. What is important is that a drive means 47 be provided for indexing the moulds 85 to the source of molten metal by rotating the wheel 32.

It will also be appreciated that the drive gear means may take other forms, such as that of a conventional drive gear. What is important is that the sprocket 100 engage a drive gear means to drive the wheel 32.

As described above, the machine 10 includes an annular ring, preferably in the form of the wheel 32. In this specification "annular" means substantially hollow. Prior art mould carousels have typically been driven from at or near the centre of the carousel ring, with the rings including drive arms extending inward to the drive means. By contrast, in the present invention, the ring is "annular", i.e. substantially hollow, meaning, inter alia, that no central drive arms rotate through the space inside the ring.

It will be understood that the use of an annular ring allows the space inside the ring to be used in a number of ways. For example, the drive means 47, and the wheel 32, are easily accessible from inside the ring; access is not impeded by moving drive arms. This allows access from inside the ring to various parts of the machine 10 for both operational and maintenance purposes. Water connection piping can be positioned inside the ring. Also, because the wheel 32 is annular, the machine 10 can be placed in a building having columns located inside the wheel 32. Because the wheel 32 is an annular ring, the building columns do not interfere with the motion of the wheel 32. Thus, the use of an annular ring provides greater flexibility in locating the wheel 32. This in turn can make it easier to locate the tilters 12,16 near the wheel 32, reducing the length of the launder 20.

In addition, in a carousel with drive arms, the ring's structures are partly cantilevered on the drive arms. By contrast, use of an annular ring results in the ring being fully and more reliably supported from below.

The water sprayer cooling system 45 preferably comprises a water pipe network 104 connected to a source of cooling water (not shown). The water sprayer cooling system 45 further comprises a plurality of nozzles 106, connected to the water pipe network 104, for spraying water onto the moulds 85. In the most preferred form of the water sprayer cooling system 45, six nozzles 106 are evenly distributed under each mould position M3-M24, so as to provide even spraying of the underside of each mould 85.

The machine 10 further includes steam retaining skirts 108 fixed to the wheel 32 and extending downwardly therefrom. In the preferred embodiment, the skirts 108 are positioned on the wheel 32 on either side of the moulds 85 and extend around the entire circumference of the wheel 32.

The machine 10 preferably further includes a floor mounted water tray 110 having upstanding side walls 112 which are curved in plan view to follow the wheel 32. The water tray 110 contains a certain level of water shown by reference numeral 114. Preferably, the tray 110 includes a drainage means (not shown) for draining accumulated water from the tray 110.

The water tray 110 further includes end walls 116 which define a water free region 118 below the wheel 32 where water is not sprayed. The water free region 118 is sized and shaped to permit the pouring and skimming of the ingots in the moulds 85. In the preferred embodiment of the machine 10, the water free region 118 extends from position M25 through position M28 to position M2 (inclusive) of the wheel 32. Thus, in the water free region 118, the moulds 85 are poured and skimmed, and the ingots are removed from the moulds 85. In addition, mould release agent is applied to the moulds 85, and the moulds 85 are preheated prior to pouring.

In the preferred form of the machine 10, the steam retaining skirts 108 extend downwardly from the wheel 32 into the water tray 110, below the water level 114. Thus, when cooling water is sprayed by the nozzles 106 onto the moulds 85, and steam is generated thereby, the steam is trapped below the wheel 32 by the steam retaining skirts 108.

The steam is then condensed by the continuing spray from the nozzles 106, with the condensate collecting in the tray 110. It will be appreciated that the use of this preferred structure for trapping and condensing the steam obviates the need for steam extraction hoods over the water spraying area.

Because they are fixed to the wheel 32, the steam retaining skirts 108 move with the wheel 32 as the wheel 32 is indexed. By contrast, the water tray 110 is floor mounted, and does not move with the wheel 32. Thus, to ensure that the skirts 108 are always present in the water spraying area, the skirts 108 extend around the circumference of the wheel 32. Also, slots 119 are provided in the end walls 116 to permit the steam retaining skirts 108 to pass through the end walls 116. In the preferred embodiment of the machine 10, the slots 119 in the end walls 116 are sized and shaped to allow a controlled amount of water to escapes from the water tray 110 through the slots 119.

The water which escapes from within the water tray 110 through the slots 119 is captured in a collection tray 122, one of which is positioned under each end wall 116. The water collected in the collection trays 122 is preferably recirculated into the water spraying system.

Thus, in the preferred water sprayer cooling system 45, the nozzles 106 are located beneath the wheel 32 and above the tray 110. Preferably, the water spray cooling system 45 is sized and otherwise configured such that the amount of water sprayed on the moulds progressively increases from position M3 through to position M24. Thus, different amounts of cooling are provided at different positions around the wheel 32. Most preferably, this is achieved by progressively increasing nozzle sizes from positions M3-M24. In addition, manual control valves 124 are provided which allow the flow of water to be adjusted. Each valve 124 controls flow to a bank of 4-6 mould positions.

Figure 6:
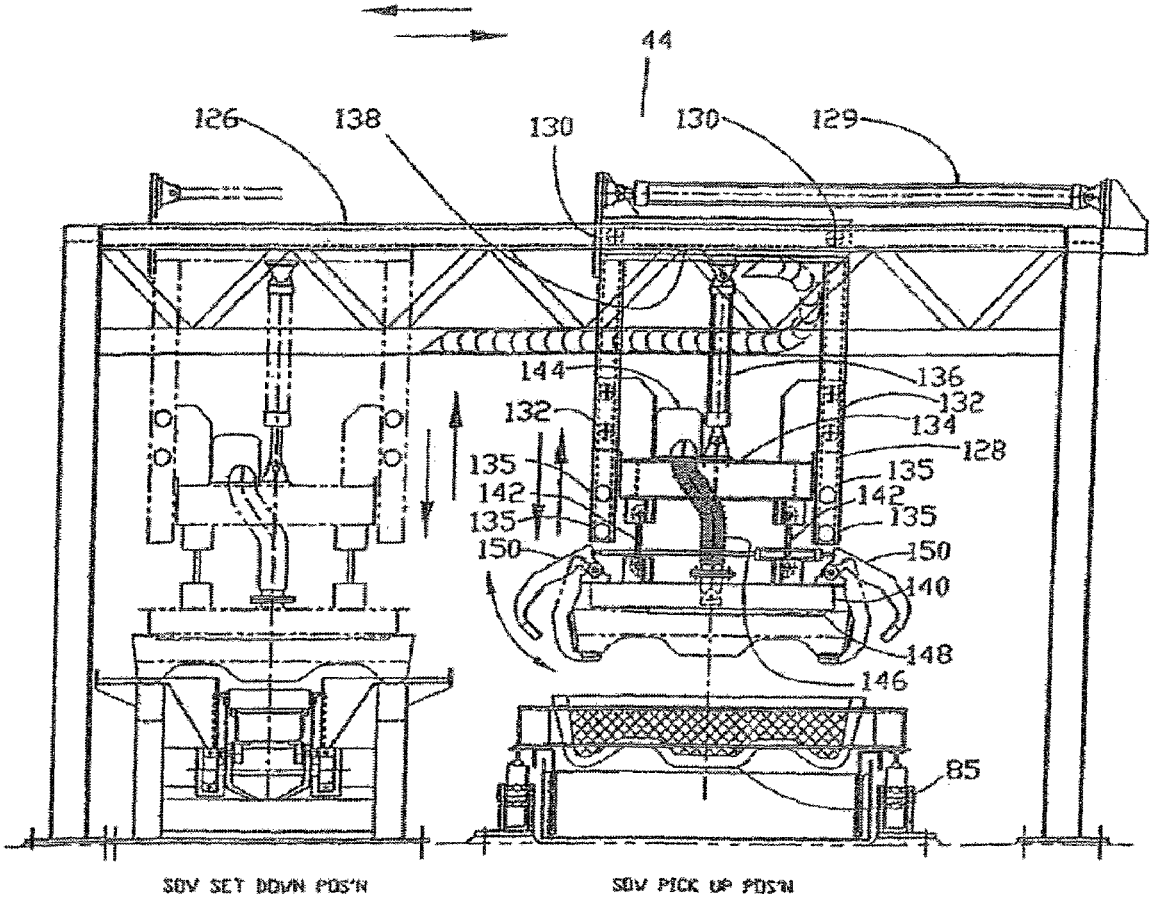
FIG. 6 is an elevation view of a vacuum ingot demoulding station.

Referring now to FIG. 6, the vacuum demoulding station 44 is shown in greater detail. The vacuum demoulding station on 44 includes a floor-mounted overhead support structure 126 for supporting the translating demoulder frame 128 as it translates from picking up the ingot from the mould 85 at position M25 of the wheel 32 to the first position of the secondary cooling line 46. Most preferably, the support structure will be a heavy duty fabrication designed to reliably support the translating frame 128. Connected to the structure 126 and the frame 128 is a hydraulic cylinder 129 for moving the frame 128 back and forth along the structure 126.

The translating frame 128 preferably comprises a rigid steel structure composed of fixed steel deck plate. The demoulding station 44 further preferably comprises four large track rollers 130 mounted on the frame 128 and the support structure 126 to allow the frame 128 to move back and forth along the support structure 126.

The frame 128 is preferably comprised of heavy wall hollow structural steel sections 132 and a central lifting element 134.

The demoulding station 44 further comprises a single hydraulic lifting cylinder 136 connected at its top end to an upper horizontal section 138 of the frame 128. At its lower end, the hydraulic lifting cylinder 136 is connected to the central lifting element 134. The up and down movement of the frame 128 is facilitated by the rollers 135.

The vacuum lifting head 140 is preferably freely suspended from the central lifting element 134 by four connectors 142, each of which is pivotally connected both to the central lifting element 134 and the vacuum lifting head 140. It will be appreciated that this structure allows the vacuum lifting head to "float", thus allowing it to move in response to small irregularities in the surface of the ingots, and to adapt its position as necessary to establish a proper vacuum seal. The demoulding station 44 further includes a source of vacuum, preferably in the form of a high-volume vacuum pump 144, which generates the vacuum for the lifting of the ingots from the moulds 85. The vacuum pump 144 preferably rests on the central lifting element 134, and is connected by a vacuum hose 146 to the vacuum lifting head 140.

Positioned on the lifting head 140 is a vacuum sealing element 148 for engaging the ingot and sealing against the ingot to allow the vacuum created by the pump 144 to form, thus facilitating the lifting of the ingot from the mould 85.

Associated with the vacuum hose 146 is a vacuum shut off valve and a vacuum switch. Preferably, the pump 144 will create a continuous vacuum, which will be turned on and off by the opening and closing of the vacuum shut off valve associated with the vacuum hose 146.

In addition, the vacuum switch is adapted to sense when an adequate lifting vacuum has been generated to lift an ingot from the mould 85. When the vacuum switch indicates that a sufficient vacuum is available to lift the ingot, the cylinder 136 lifts the lifting head 140, which in turn lifts the ingot out of the mould 85. At this point, safety arms 150 swing under the ingot to ensure that the ingot does not fall in the event that the vacuum is unexpectedly cut off. The translating frame 128 then moves to the ingot drop off position, i.e. the first position on the cooling line 46. The safety arms 150 then swing out from under the ingot, the lifting head 140 is lowered, and the vacuum is shut off by the vacuum shut off valve, thus releasing the ingot onto the cooling line 146.

Preferably, four safety arms 150 are provided, though it will be appreciated that a different number of safety arms 150 could be used.

Figure 7:
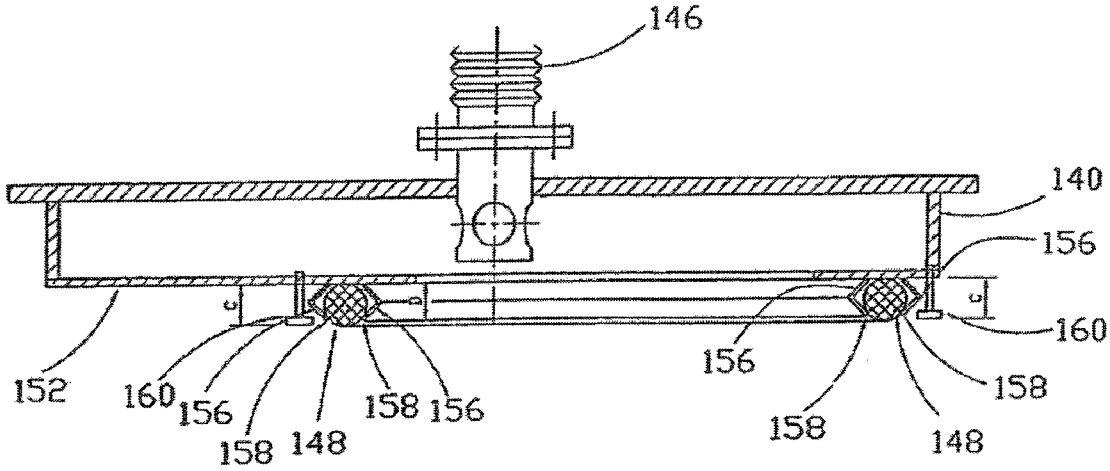
FIG. 7 is a cross-sectional view of the vacuum head associated with the vacuum ingot demoulding station.
Figure 8:
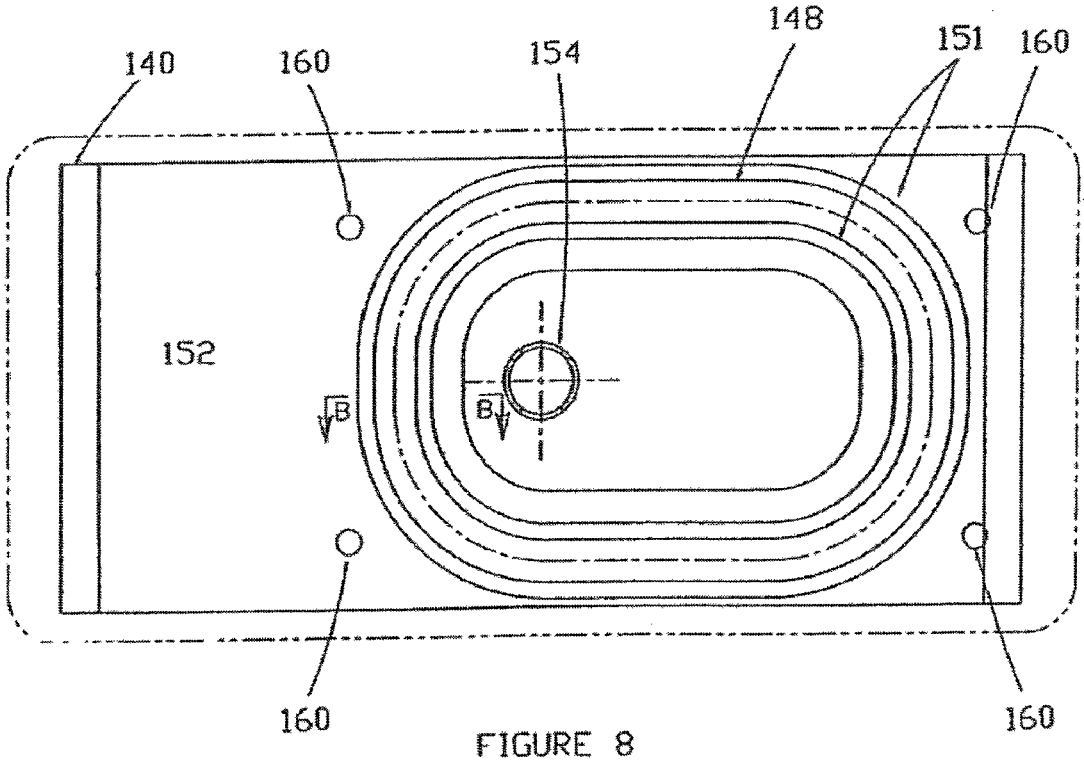
FIG. 8 is a bottom view of the vacuum head.
Figure 9:
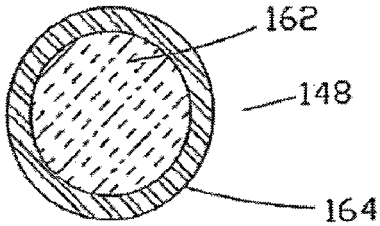
FIG. 9 is a cross-sectional view of the sealing element along line B-B of FIG. 8.

FIGS. 7, 8 and 9 show the vacuum seal arrangement in greater detail. The vacuum seal arrangement includes the sealing element 148. The arrangement further includes one or more retaining elements 151 located on the lower face 152 of the lifting head 140 for releasably retaining the sealing element 148 on the lifting head 140. Preferably, the sealing element 148 is shaped such that the vacuum lifting area has no sharp corners. Most preferably, the sealing element 148 will form a substantially circular or substantially oval vacuum lifting area when the vacuum is generated via the pump 144, the vacuum hose 146 and the vacuum orifice 154 located in the lifting head 140.

It will be appreciated that the invention comprehends the use of different numbers and types of retaining elements 151, such as, for example, a dovetail groove in the head 140 sized and shaped to retain the sealing element 148. However, most preferably, the retaining element 151 comprises a pair of continuous (i.e. without gaps) flanges in the form of steel angles 156. The angles 156 are positioned so as to be opposed and angled toward one another, with the sealing element 148 wedged between the angles 156 so as to be retained therebetween, and against the lower face 152. The angles 156 define a closed shape in the plane of the lower face 152, which holds all portions of the sealing element 148 against the lower face 152, thus obviating the need for separate fasteners for the sealing element 148. In addition, because the retaining element 151 is continuous and a closed shape, the element 151 has no end edges against which the sealing element 148 can rub and wear during use.

The angles 156 have outer edges 158 which extend a distance D from the bottom faced 152 of the lifting head 140. Preferably, the distance D will be greater than one-half of the cross-sectional diameter of the sealing element, but less than the diameter of the sealing element 148.

Preferably, the sealing element 148 is substantially circular in cross section and is deformable to fit between the angles 156 of the retaining elements 151. It will be appreciated that this structure allows the sealing element 148 to be inserted into the retaining elements 151 and retained against the bottom face 152 of the lifting head 140 without the requirement of separate fasteners. Instead, when it is desired to replace an old sealing element 148, the sealing element 148 is pulled from the lifting head 140. The sealing element 148 being replaced deforms as a result of the pulling and squeezes out of the retaining element 151. The new sealing element 148 is then pressed against the open space between the two angles 156 of the retaining element 151. The new sealing element 148 deforms and squeezes between the angles 156. The angles 156, being angled toward one another as they extend outwardly from the bottom face 152 of the lifting head 140, hold the sealing element 148 in place.

Because the distance D is more than half the sealing element diameter but less than the sealing element diameter, the sealing element 148 is retained in place, but the sealing element 148 is also permitted to extend outwardly beyond the angles 156, thus permitting the sealing element 148 to properly seal against the ingot for lifting. Thus, the sealing element 148 is deformable to fit between the flanges 156, but the flanges 156 are sized and shaped to retain the sealing element 148 to the lifting head 140 when the sealing element 148 is not deformed, and to permit the sealing element 148 to engage an ingot when an ingot is to be lifted from the mould 85.

The vacuum seal arrangement may further includes four seal compression limiters 160. The seal compression limiters 160 function as stops which, when the vacuum is created, prevent the sealing element 148 from compressing too much between the bottom face 152 and the ingot being lifted. It will be appreciated that excessive compression of the sealing element 148 during lifting will reduce the useful life of the sealing element 148 by, inter alia, causing permanent deformation of the sealing element 148.

The seal compression limiters 160 preferably extend from the bottom face 152, thus acting as rigid stops which maintain a predetermined distance C between the bottom face 152 and the ingot being lifted. The limiters 160 thus create a compression limit for the sealing element 148. Preferably, the limiters 160 are threaded, and are sized and shaped to fit into threaded holes on the bottom face 152 of the lifting head 140. Thus, by rotating the limiters 160, the distance C can be adjusted, thus adjusting the compression limit for the sealing element 148.

It will be appreciated that the invention comprehends other numbers and types of seal compression limiters than the preferred configuration described above. What is important is that compression of the element 148 be limited to reduce deformation thereof.

The sealing element 148 is preferably composed of a flexible, fiber cord core 162, which is rounded in cross-section and made from a high temperature resistant material. The sealing element 148 further preferably includes a flexible, metallic, abrasion-resistant outer layer on the core 162, most preferably in the form of a form of a flexible stainless steel mesh sheathing 164.

It will be appreciated that providing a core 162 made from a temperature resistant material is preferred, as the ingots are still quite hot (typically about 550° C.) when they are demoulded at the vacuum demoulding station 44. Therefore, a temperature resistant material is preferred to protect the sealing element 148 from heat damage.

In addition, it will be appreciated that, when the sealing element 148 engages the ingots, and the vacuum is initiated, the sealing element 148 will be sucked slightly inwardly (i.e. toward the orifice 154) because of the vacuum, thus causing the sealing element 148 to rub against the ingot. Ingots generally have at least some surface irregularities. Thus, when the sealing element 148 rubs against the ingot, the sealing element 148 may be abraded by the surface irregularities of the ingots.

As a result, use of the abrasion-resistant outer layer in the form of the stainless steel mesh sheathing 164 is preferred. This sheathing protects the core 162 from abrasion and erosion when the vacuum is initiated, and prolongs the life of the sealing element 148.

Figure 10:
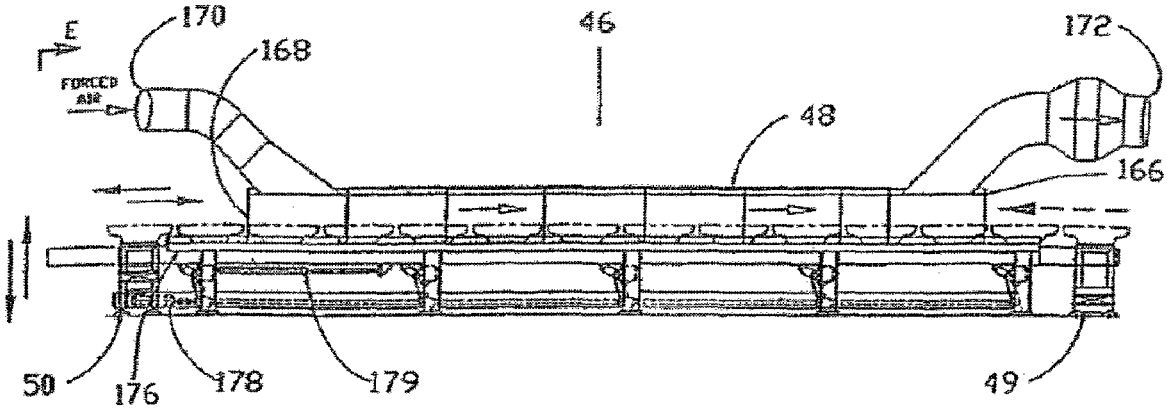
FIG. 10 is a side elevation view of a secondary ingot cooling tunnel according to the present invention.
Figure 11:
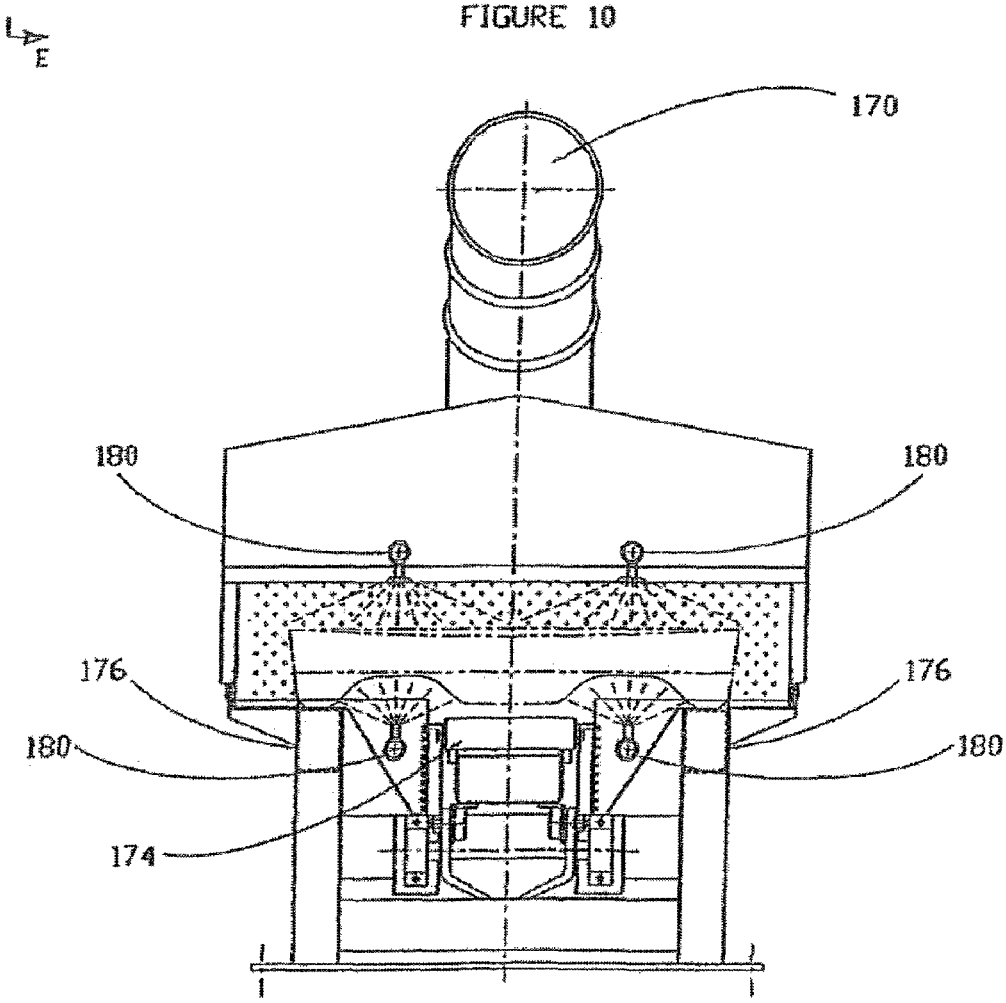
FIG. 11 is a rear elevation view taken along line E-E of FIG. 10.

Referring now to FIGS. 10 and 11, the secondary cooling line 46 includes a tunnel 48 through which the ingots pass after being demoulded by the vacuum demoulding station 44. Air "knives" are provided at the inlet 166 of the cooling tunnel 48 to blow off any loose aluminium pieces from the ingots before they enter the cooling tunnel. Air "knives" are also included at the exit 168 of the cooling tunnel 48 to blow off any excess water remaining on the ingot after it passes through the tunnel 48. This facilitates subsequent adherence of labels and ink to the ingots, if it is desired to label or make the ingots.

To provide additional heat exchange in cooling the ingot, forced air is circulated into the tunnel from a forced air inlet 170 adjacent to the outlet 168. This provides a countercurrent airflow (i.e. in the direction opposite to the movement of the ingots) for cooling the ingots. The countercurrent airflow exits the cooling tunnel 48 from a forced air outlet 172 positioned adjacent to the inlet 166.

The ingots are indexed along the cooling tunnel 48 on a walking beam conveyor, which includes a walking rail 174 and two stationary rails 176. In operation, the walking rail 174 lifts vertically raising all of the ingots from their resting places on the stationary rail 176. The walking rail 174 then moves forward by one position, then lowers the ingots back onto the stationary rail 176, having moved them forward by one position along the stationary rail 176. The ingots are thus moved forward by one ingot position each time the walking rail 174 operates. The walking rail 174 then returns to its initial lifting position, so that it can again index the ingots forward by one position.

The walking rail 174 is moved vertically by hydraulic actuator 178 and horizontally by actuator 179, both of which have associated therewith proximity switches that are used to detect when the walking rail 174 is in its fully up, fully down, fully forward and fully retracted positions.

The cooling tunnel 48 acts as an enclosure for the walking beam conveyor. In addition to the forced air cooling described above, the secondary cooling line 46 also employs water spray cooling. Specifically, at each ingot position along the secondary cooling line 46, four water nozzles 180 are provided, two of which are positioned above the ingot and spray the top portion thereof, and two of which are positioned below the ingot, spraying cooling water on the bottom portion thereof.

It will be appreciated that the invention comprehends other configurations for the line 46 than the preferred nozzle configuration described above. What is important is that a source of cooling water be provided to spray the ingots moving within the cooling tunnel 48.

Various modifications and alterations are possible to the form of the invention without departing from the scope of the broad claims attached hereto. For example, the annular ring may take other forms besides the wheel 32. A metal other than aluminum may be used. Similarly, the drive means 47 may take a different form from the cam followers and sprocket described. What is important is that the aluminium ingot casting machine comprise a source of molten metal, a rotatable annular ring for carrying a plurality of ingot casting moulds, and a drive means for indexing moulds by rotating the annular ring. Preferably, the vacuum seal arrangement includes a sealing element having a flexible core and a flexible abrasion resistant outer layer on the core, and one a means for retaining the sealing element.

The embodiments of the invention in which an exclusive property or privilege is claimed are defined as follows:

1. An aluminum ingot casting machine comprising:

a source of molten metal;

a substantially hollow rotatable annular ring, said ring defining an open central portion inside said ring, said annular ring having a vertical axis of rotation and being sized and shaped to carry a plurality of ingot casting molds, the annular ring comprising a mold-carrying carousel and a support structure supporting the carousel, the support structure comprising an inner and an outer circular rail, wherein said open central portion is devoid of any components mounted to the annular ring which extend diametrically across the open central portion; and a drive means, located substantially outside said open central portion, for indexing said molds to said source of molten metal by rotating said annular ring, the drive means comprising a drive gear means fixed to one of said circular rails, and a drive sprocket for driving said drive gear means.

2. An aluminum ingot casting machine as claimed in claim 1 wherein the support structure further includes a plurality of floor mounted support rollers to support said circular rails.

3. An aluminum ingot casting machine as claimed in claim 1 wherein the inner and outer circular rails comprise a floor-mounted inner and a floor-mounted outer circular rail, and wherein the support structure further comprises a plurality of rollers, supported by said rails, supporting said carousel.

4. An aluminum ingot casting machine as claimed in claim 3 wherein said drive means acts between said floor and said carousel, to rotate said annular ring on said support structure.

5. An aluminum ingot casting machine as claimed in claim 1 wherein the drive gear means comprises a series of cam followers.

6. An aluminum ingot casting machine as claimed in claim 1 wherein said drive sprocket is powered by an AC electric motor.

7. An aluminum ingot casting machine as claimed in claim 6 wherein said motor is controlled by a variable frequency controller.

8. An aluminum ingot casting machine as claimed in claim 1 wherein said annular ring includes a steam retaining skirt extending downwardly therefrom.

9. An aluminum ingot casting machine as claimed in claim 1 wherein said substantially hollow rotatable annular ring is free from operational components extending across the open central portion defined by said ring and across a central axis of the rotatable annular ring.

10. An aluminum ingot casting machine comprising:

a source of molten metal, the source of molten metal comprising at least two pivoting crucibles to permit continuous pouring of molten aluminum;

a substantially hollow rotatable annular ring, said ring defining an open central portion inside said ring, said annular ring having a vertical axis of rotation and being sized and shaped to carry a plurality of ingot casting molds, wherein said open central portion is devoid of any components mounted to the annular ring which extend diametrically across the open central portion;

a drive means, located substantially outside said open central portion, for indexing said molds to said source of molten metal by rotating said annular ring; and a Y-shaped launder, the launder having first and second receiving portions for receiving molten metal, the first receiving portion being positioned to receive molten metal from one of said crucibles and the second receiving portion being positioned to receive molten metal from another of said crucibles, the launder further comprising a molten metal delivery portion extending between the receiving portions and the carousel.

11. An aluminum ingot casting machine as claimed in claim 10 further including a pivoting tundish.

12. An aluminum ingot casting machine as claimed in claim 11 wherein said pivoting tundish includes a ceramic nozzle for under pouring said molten metal in said molds.

13. An aluminum ingot casting machine as claimed in claim 12 wherein said tundish pivots between a lower pouring position and a raised non-pouring position.

14. An aluminum ingot casting machine as claimed in claim 13 further including an automatic skimming apparatus.

15. An aluminum ingot casting machine as claimed in claim 10 wherein said substantially hollow rotatable annular ring is free from operational components extending across the open central portion defined by said ring and across a central axis of the rotatable annular ring.

16. An aluminum ingot casting machine comprising:

a source of molten metal;

a substantially hollow rotatable annular ring, said ring defining an open central portion inside said ring, said annular ring having a vertical axis of rotation and being sized and shaped to carry a plurality of ingot casting molds, the annular ring comprising a mold-carrying carousel and a support structure supporting the carousel, the support structure comprising an inner and an outer circular rail, wherein said open central portion is devoid of any components mounted to the annular ring which extend diametrically across the open central portion; and a drive means, located substantially outside said open central portion, for indexing said molds to said source of molten metal by rotating said annular ring, the drive means comprising a drive gear means fixed to said carousel, and a drive sprocket for driving said drive gear means.

17. An aluminum ingot casting machine as claimed in claim 16 wherein the support structure further includes a plurality of floor mounted support rollers to support said circular rails.

18. An aluminum ingot casting machine as claimed in claim 16 wherein the inner and outer circular rails comprise a floor-mounted inner and a floor-mounted outer circular rail, and wherein the support structure further comprises a plurality of rollers, supported by said rails, supporting said carousel.

19. An aluminum ingot casting machine as claimed in claim 18 wherein said drive means acts between said floor and said carousel, to rotate said annular ring on said support structure.

20. An aluminum ingot casting machine as claimed in claim 16 wherein said substantially hollow rotatable annular ring is free from operational components extending across the open central portion defined by said ring and across a central axis of the rotatable annular ring.

* * * * *